US006050448A

United States Patent [19]

Willis

[11] Patent Number: 6,050,448

[45] Date of Patent: Apr. 18, 2000

[54] CARD DISPENSING CASSETTE

[75] Inventor: Marcus Willis, Kent, United Kingdom

[73] Assignee: Asahi Seiko Co., Ltd., Tokyo, Japan

[21] Appl. No.: 09/041,495

[22] Filed: Mar. 12, 1998

[30] Foreign Application Priority Data

Mar. 12, 1997 [JP] Japan ..... 9-097845

[51] Int. Cl.[7] ..... B65H 1/00

[52] U.S. Cl. ..... 221/197; 221/154; 221/287

[58] Field of Search ..... 221/154, 197, 221/198, 232, 253, 259, 287

[56] References Cited

U.S. PATENT DOCUMENTS 4,789,079 12/1988 Kobayashi et al. ..... 221/232

4,993,587 2/1991 Abe .

5,647,507 7/1997 Kasper ..... 221/154 X

*Primary Examiner*—William E. Terrell

*Assistant Examiner*—Gene O. Crawford

*Attorney, Agent, or Firm*—McGlew and Tuttle, P.C.

[57] ABSTRACT

A card dispensing cassette includes a housing in which cards are stacked. A dispense outlet is provided in the housing through which cards are laterally dispensed from the cassette. A card retainer, cooperating with the dispense outlet, is slidably mounted to the cassette for substantially lateral movement between a closed position in which cards cannot be dispensed and an open position in which cards can be dispensed. The card retainer has a retaining lip which engages any cards protruding through the dispense outlet when the card retainer moves to its closed position so as to return those cards into the cassette.

19 Claims, 20 Drawing Sheets

CARD DISPENSING CASSETTE

FIELD OF THE INVENTION

This invention relates to a card dispensing cassette for thin cards such as magnetic cards, telephone cards or IC cards. This invention also relates to card dispensing equipment which is suitable for vending machines to sell cards.

BACKGROUND OF THE INVENTION

Card dispensing equipment for card vending machines is disclosed in the specification of Japanese Utility Model Application 63-60147 (which corresponds to Japanese Utility Model Publication 7-26276 and U.S. Pat. No. 4,993,587).

As shown in FIG. 7, this card dispensing equipment comprises a card store 50 for holding a card stack 3 and defined by side plates 1,2, a support plate 4 for supporting this card stack 3 from the lower portion, and a feed roller 5 on a drive axle 6 which is provided under the support plate 4 and protrudes through a window 38.

A further pair of rollers 7 on an axle 11 are provided between the feed roller 5 and a dispense outlet.

The feed rollers 7 feed out to the dispense outlet 40 the card which was fed from the bottom of the stack 3 by positive rotation of the feed roller 5.

Above the feed rollers 7, a reverse roller 8 on an axle 12 is provided to be driven in the opposite direction to the card feed direction.

Further, this reverse roller 8 defines a gap with the rollers 7 which allows only one card to pass on being fed out by a projecting portion 37 of the feed roller 5. When the gap is filled with the card, the feed roller 5 is reversed.

The reverse roller 8 is driven in conjunction with axle 6, i. e. f or the same duration as the period f or dispensing a card. Its job is to push any cards above the card being dispensed back into the stack, thus preventing a "double dispense".

The cards are fed to a discharge roller 9 on an axle 13 cooperating with an auxiliary roller 10 on an axle 14. The rollers are driven by a drive motor 15 having a drive shaft 16 coupled to pulleys 17,19,20,21,22 and 24 by belts 18,23. A weight 39 holds the cards down and a detector switch 44 is provided.

Conventional cassettes as described above are relatively insecure and, in particular, when a cassette is removed from dispensing equipment, there is a risk that one or more cards may protrude through the dispense outlet and could therefore be accessed by unauthorized persons.

SUMMARY AND OBJECTS OF THE INVENTION

It is a primary object of the present invention to provide a card dispensing cassette comprises a housing in which cards are stacked in use; a dispense outlet in the housing through which cards are laterally dispensed from the cassette; and a card retainer, cooperating with the dispense outlet, slidably mounted to the cassette for substantially lateral movement between a closed position in which cards cannot be dispensed and an open position in which cards can be dispensed, the card retainer having a retaining lip which engages any cards protruding through the dispense outlet when the card retainer moves to its closed position so as to return those cards into the cassette.

With this new cassette, a card retainer is provided which prevents cards from being dispensed from the cassette when in its closed position and which, when moved from its open position to its closed position, will engage any cards protruding through the dispense outlet so as to return them into the cassette. This enables a much more secure operation to be achieved, particularly when a cassette is mounted to and removed from dispensing equipment. Thus, the equipment can be arranged to move the card retainer to its closed position before the cassette can be removed from the dispensing equipment. This prevents cards from being removed when the cassette is not attached to the dispensing equipment.

In some cases, the card retainer will simply slide in a general orthogonal direction relative to the stacking direction but conveniently the cassette further comprises guide means for causing the card retainer to tip during its movement towards the open position so as to reduce interference between the lip and the path of cards being dispensed. This simplifies the construction of dispensing equipment for removing cards from the cassette. The guide means is most conveniently provided by one or more pairs of cooperating pins and slots.

In one embodiment, the card retainer is moved manually by means of a handle coupled to the card retainer and extending through a slot in a wall of the housing.

In an alternative, preferred embodiment, the cassette further comprises a gear assembly for coupling the card retainer to a drive shaft which is connected in use to an actuator. This allows the card retainer to be automatically moved, for example where the actuator is provided by part of dispensing equipment.

Cards could be pushed out of the cassette in any conventional way but in the preferred arrangement, the card retainer includes a window through which cards in the stack can be engaged by a feed member.

In order to provide additional security, preferably the cassette further comprises a first latch member movable between a locked position in which it engages and locks the card retainer in its closed position and a released position in which the card retainer can be moved to its open position. This avoids unauthorized access being obtained to cards in the cassette when the cassette is not attached to dispensing apparatus. Conveniently, the first latch member is primed in its released position to return to the locked position once the card retainer has been moved to its open position whereby the card retainer is automatically locked by the first latch member when the card retainer returns to its closed position. This means that there is much less chance of the card retainer being inadvertently or fraudulently opened when it has moved back to its closed position. Preferably, the first latch member can it only be unlocked from within the housing so as to provide additional security.

The invention also relates to card dispensing apparatus comprising a card dispensing cassette according to the invention; and a dispenser to which the cassette can be mounted, the dispenser being adapted to feed cards from the cassette through the dispense outlet to an output position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 5:
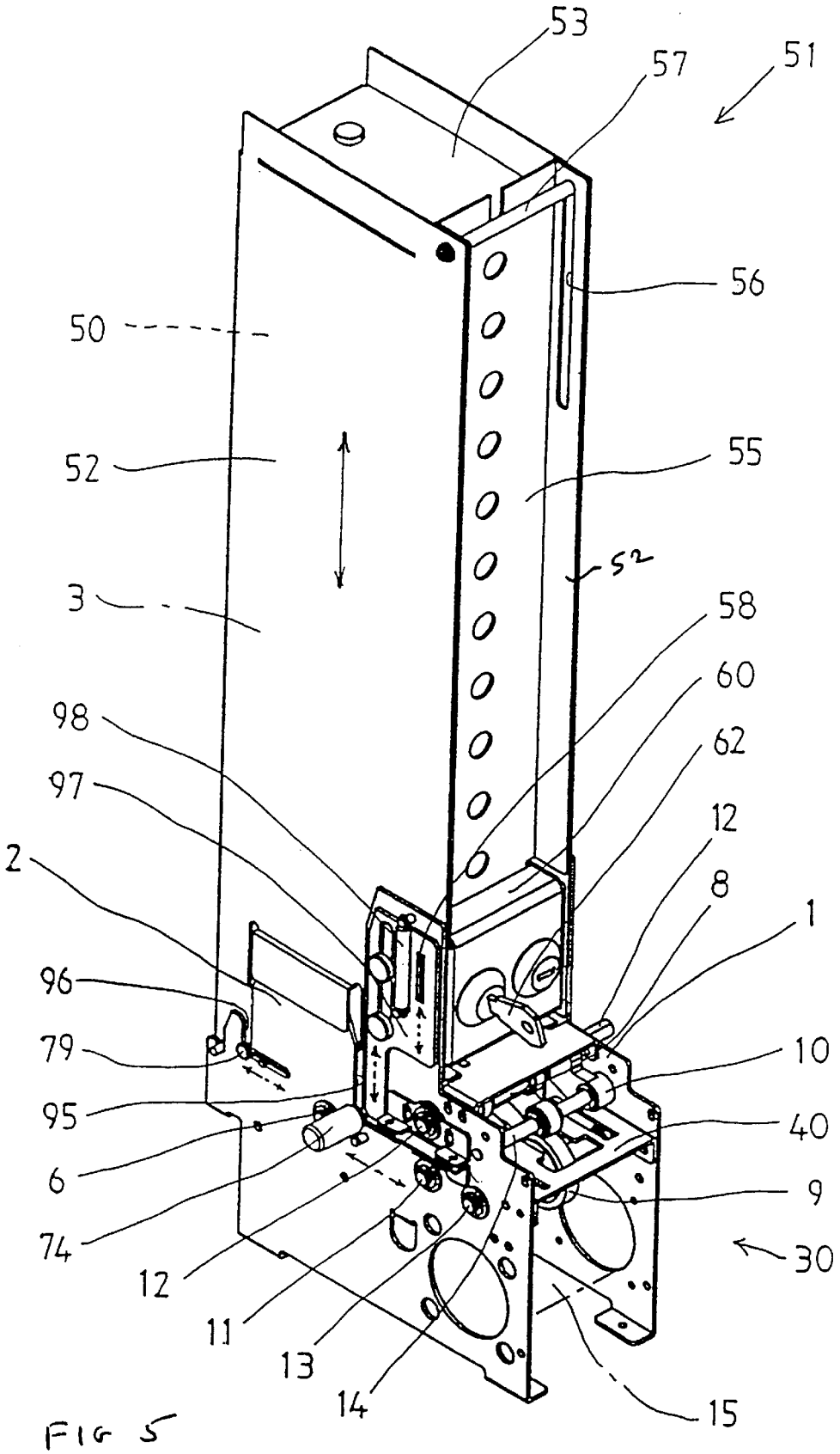
FIG. 5 is a perspective view from one side, above and the front showing the cassette mounted on dispensing apparatus.
Figure 6:
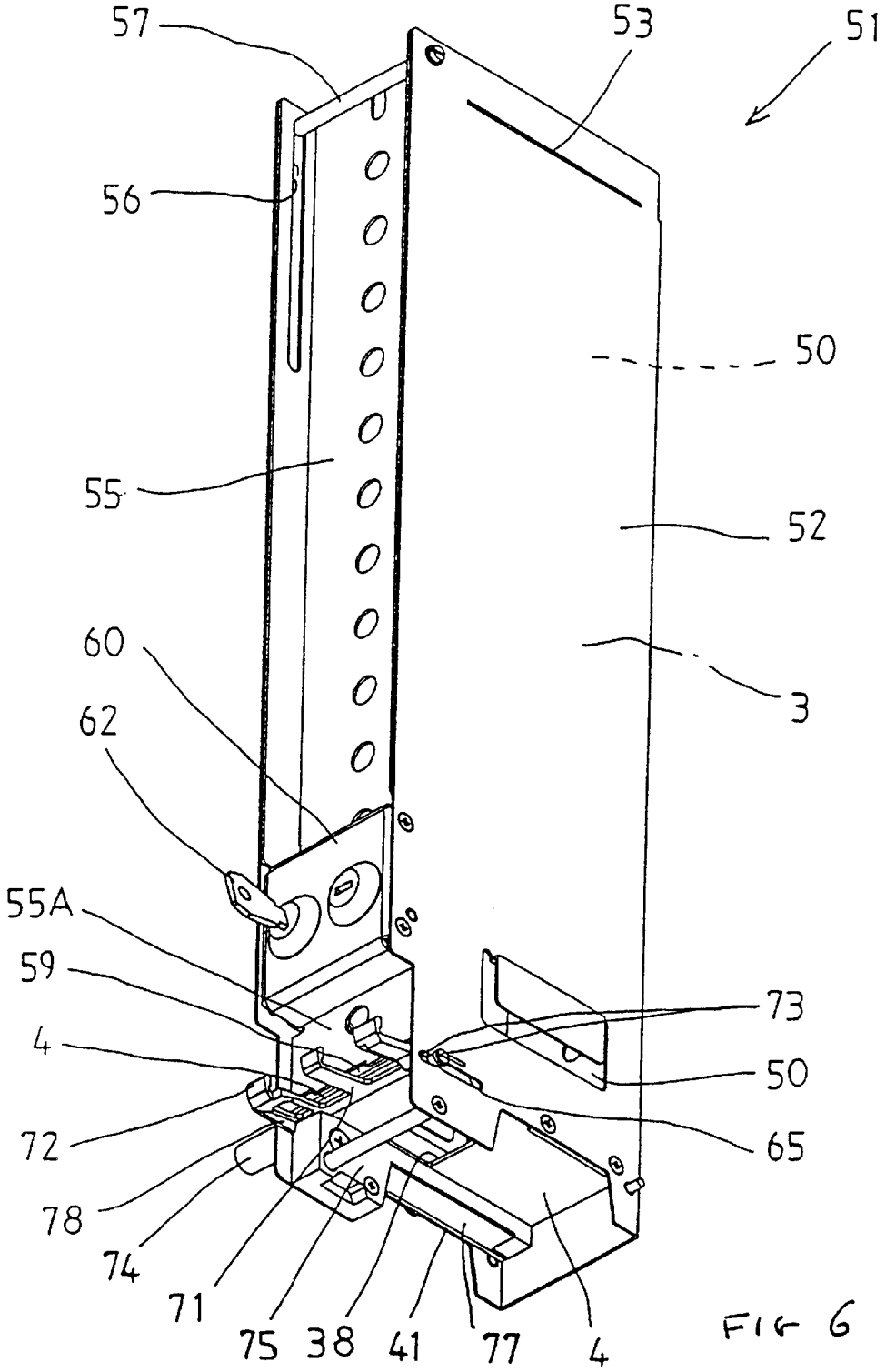
FIG. 6 is a perspective view from the front, the other side and below the cassette with the card retainer in its open position.
Figure 7:
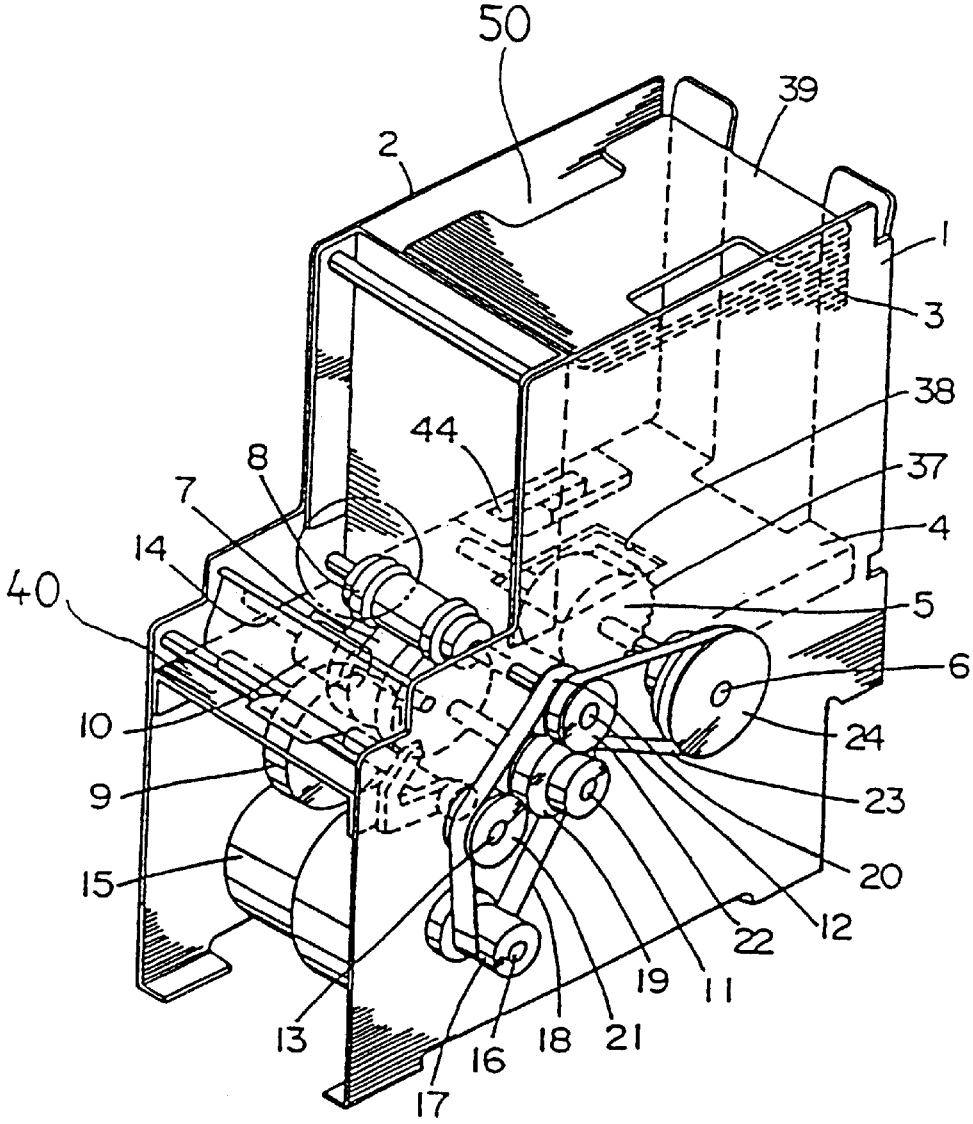
FIG. 7 is a perspective view of a known card dispensing apparatus and cassette.

Referring to the drawings, and in particular to FIGS. 1 to 6 and 8, those parts which are similar to parts in FIG. 7 have been given the same reference numerals for convenience,.

FIGS. 1 to 6 and 8 illustrate a cassette 51 having a pair of side plates 52, a front plate 55 secured between the side plates 52 so that the side plates protrude slightly beyond the front plate, a rear plate (not shown), a top plate 53 and a bottom plate 4. The front plate or panel 55 can be opened and closed to allow access into a card store 50. A dispense outlet 59 is formed between the bottom plate 4 and the lower end of the front panel 55. A window 38 (FIG. 4) is provided in the bottom plate 4 to allow access to the lowermost card in a stack contained in the cassette by a feed roller 5.

Figure 1:
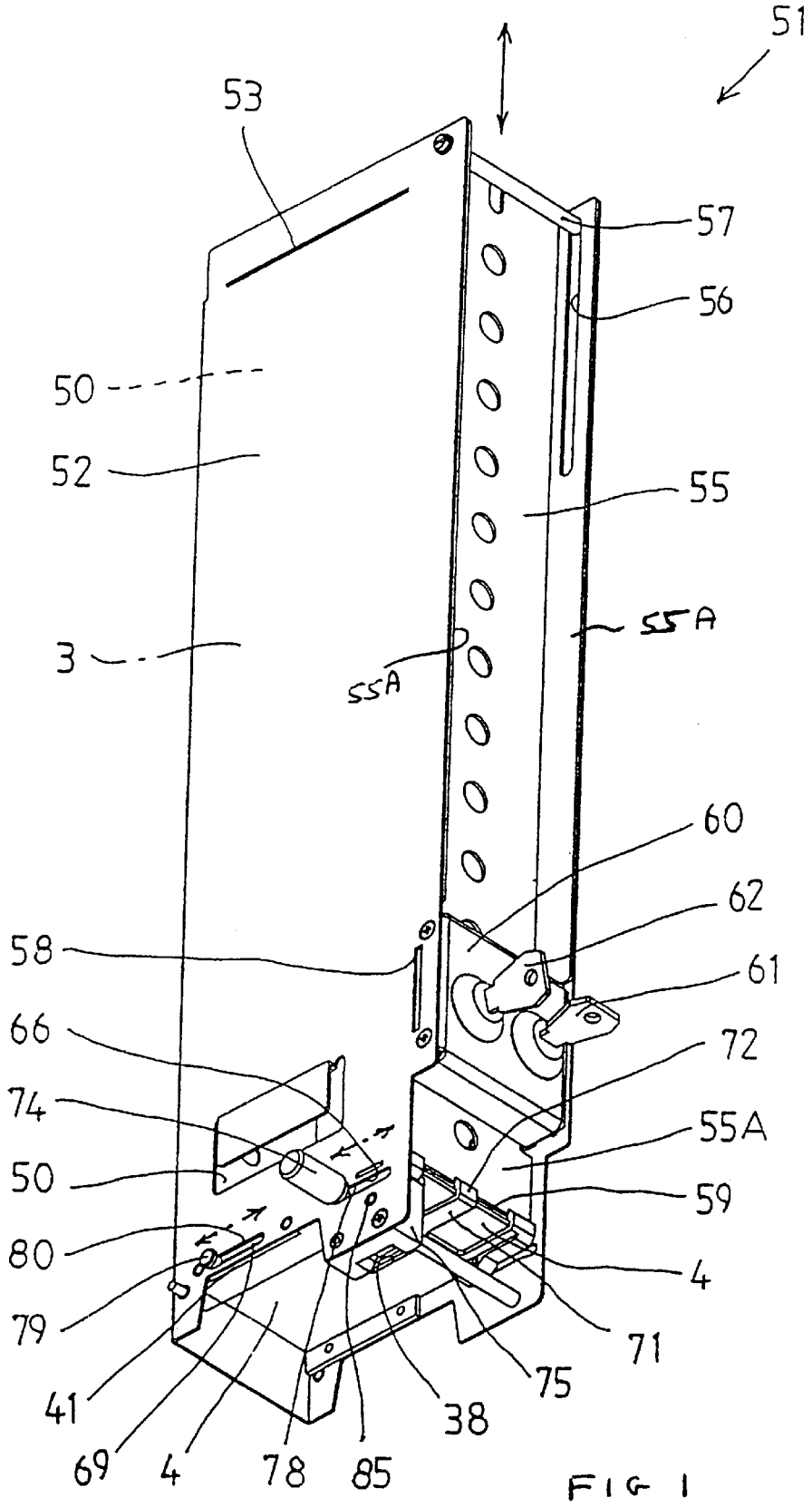
FIG. 1 is a perspective view from below and from the rear of a first example of a cassette.

Slots 56, one of which is shown in FIGS. 1 and 5, are formed in upper ends of side flanges 55A of the front panel 55, an axle 57 connected between the side plates 52 extending into the slots to enable the front panel 55 to move up and down and to rotate.

The panel 55 is locked in position by means of a lock assembly 60 provided with first and second lock/key arrangements 61, 62. A lower part 55A of the front panel 55 (FIG. 2) extends within the lock assembly 60 slidably and is locked in its closed position by a projection 63 forming part of the lock/key arrangement 61.

Rotation of the second lock/key arrangement 62 causes a projection 64 to extend through a slit in the left hand side wall 52 (FIGS. 1 and 5) to lock the cassette to the dispensing equipment.

Of course, the keys of each key/lock arrangement 61, 62 can be removed once they have been turned to their locked position.

Figure 4:
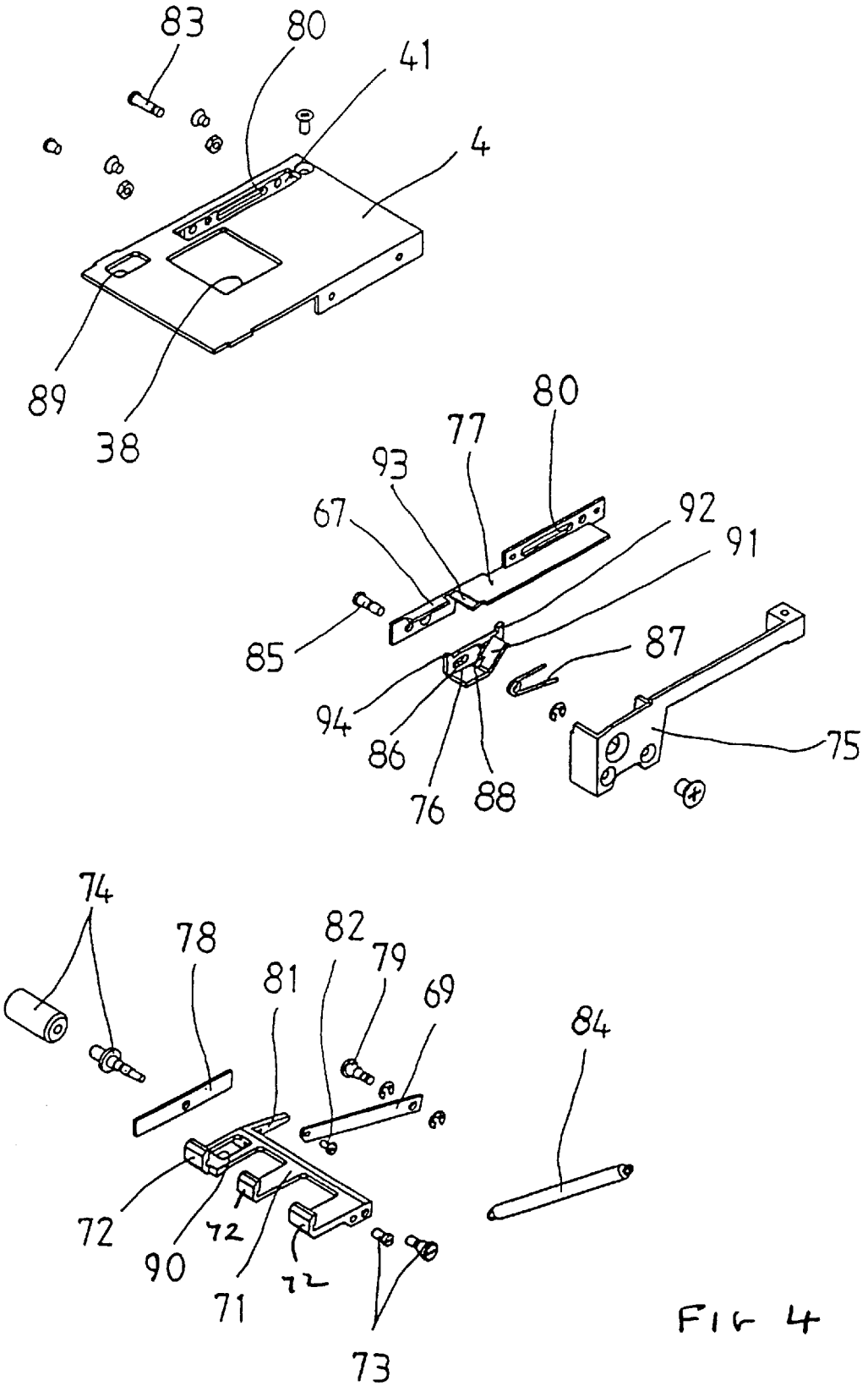
FIG. 4 is an exploded view of some of the components shown in FIG. 3.

Cooperating with the dispense outlet 59 is a card retainer 71 having an E shape as can be seen most easily in FIG. 4. Each arm 72 of the card retainer 59 is bent upwardly at its tip, each tip being aligned with a respective notch 55B at the lower edge of the front panel lower part 55A.

A pair of pins 73 extend from the right hand end of the card retainer 71 while a lever axle 74 extends from the left hand end. The pins 73 protrude through a guide slot 65 in the right hand side plate 52 (FIG. 6) while the lever axle 74 protrudes through a slot 66 in the left hand side plate 52 (FIG. 1).

The mechanism for operating the card retainer 71 is mounted in a secure cover 75 attached to the inside of the left hand side wall 52. The actuating mechanism includes a laterally extending plate 77 fixed to a mounting plate 41 below the bottom plate 4. A pin 83 extends through the mounting plate 41 towards the rear of the plate 77. The card retainer 71 is mounted on the projecting portion of the lever axle 74 which extends through a slide plate 78. A link plate 69 is pivotally mounted to a rearwardly extending projection 81 of the card retainer 71 by means of a pin 82. A pin 79 for guiding sliding movement of the link plate 69 is fixed to the rear of the link plate 69. The pin 79 is slidably received in a slot 80 formed in the left hand side plate 52 and in a mounting bracket attached to the plate 77.

An extension spring 84 extends between the pin 74 and the pin 83 so as to urge the card retainer 71 into its closed position shown in FIG. 1. A pin 85 extends through an aperture in the left side plate 52, through an aligned aperture in a further bracket attached to the plate 77 and into a slot 86 of a V-shaped latch body 76. The latch body 76 is slidably and rotatably mounted on the pin 85.

A V-shaped spring 87 has one arm in contact with the cover body 75 and the other arm in contact with a part 88 of the latch body 76.

Figure 3:
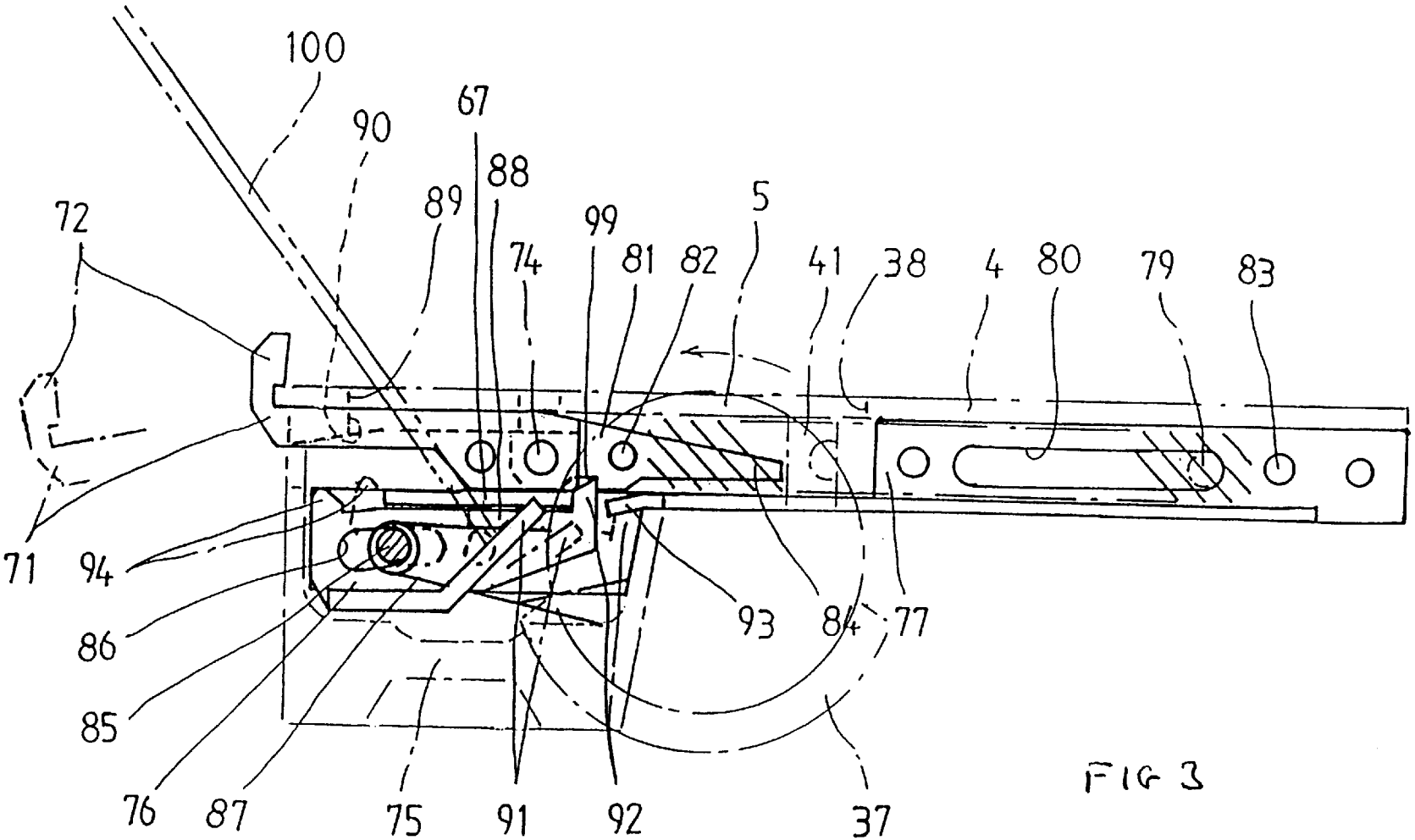
FIG. 3 is a further enlarged, side view of the card retainer mechanism of the cassette shown in FIGS. 1 and 2.

In order to prepare the cassette, a manager will unlock the lock/key arrangement 61 and draw up the front panel 55 and will insert a long bar 100 (FIG. 3) through the dispense outlet 59. The tip of the bar 100 is contacted against an operating part 91 of the latch body 76 through a small window 89 in the bottom plate 4 and a small window 90 in the card retainer 71. When the bar 100 is pushed down and forward against the action of the spring 87, the latch body 76 will move a distance corresponding to the length of the slot 86 to the right as seen in FIG. 3. When the bar 100 is then removed, a projection 92 on the latch body 76 is contacted and caught by an angled extension of the plate 77 (see chain lines in FIG. 3 and also FIG. 8B) and at this time a further projection 94 of the latch body 76 projects from the plate 77.

Following removal of the bar 100, the front panel 55 is lowered and the key of the arrangement 61 is rotated to lock the panel 55 with the projection 63. After this, the key is removed. The cassette is then placed on card dispensing apparatus 30 of a vending machine as seen in FIG. 5.

The dispensing apparatus 30 comprises right and left side plates 1,2 separated by a top plate 40. When the cassette is mounted onto the dispensing apparatus, the lever axle 74 and the larger of the pins 73 are inserted respectively in L-shaped holes 95 formed in each of the side plates 1, 2 and extending over a feed roller axis 11. At the same time, the pin 79 is inserted into a small L shaped hole 96 which is formed near the rear edge of the left side plate 2. This can be seen in FIG. 5. After this, the lever axle 74 is pulled towards the feed roller axis 11 against the force of the spring 84 following which the key 62 is rotated so that the projection 64 protrudes through the slot 58. This movement causes a lock plate 97 slidably mounted to an upward extension of the side plate 2 to be pushed downwardly against the force of a spring 98. As a result, the lever arm 74 is locked against movement under the resilience of the spring 84 by a lower projection of the lock plate 97. Thus, the cassette is locked onto the card dispensing apparatus 30 of the vending machine. After this, the operator removes the second key 62. It should be noted in passing that the key/lock arrangement 62 could be mounted to the dispensing apparatus 30.

FIG. 6 illustrates the condition of the cassette 51 before the second key 62 has been removed. (The dispensing apparatus is omitted in FIG. 6.) It will be seen from FIG. 6 and also FIG. 8C that movement of the lever arm 74 draws forward the card retainer 71. It will also be noted that the card retainer 71 has been moved downwardly and this is caused by movement of the smaller of the pins 73 in the slot 65 which has a corresponding downward extension near the front edge of the slide plate 3. As a result, the three tips 72 of the card retainer 71 do not interfere with cards 3 being fed out of the dispense outlet.

Figure 8:
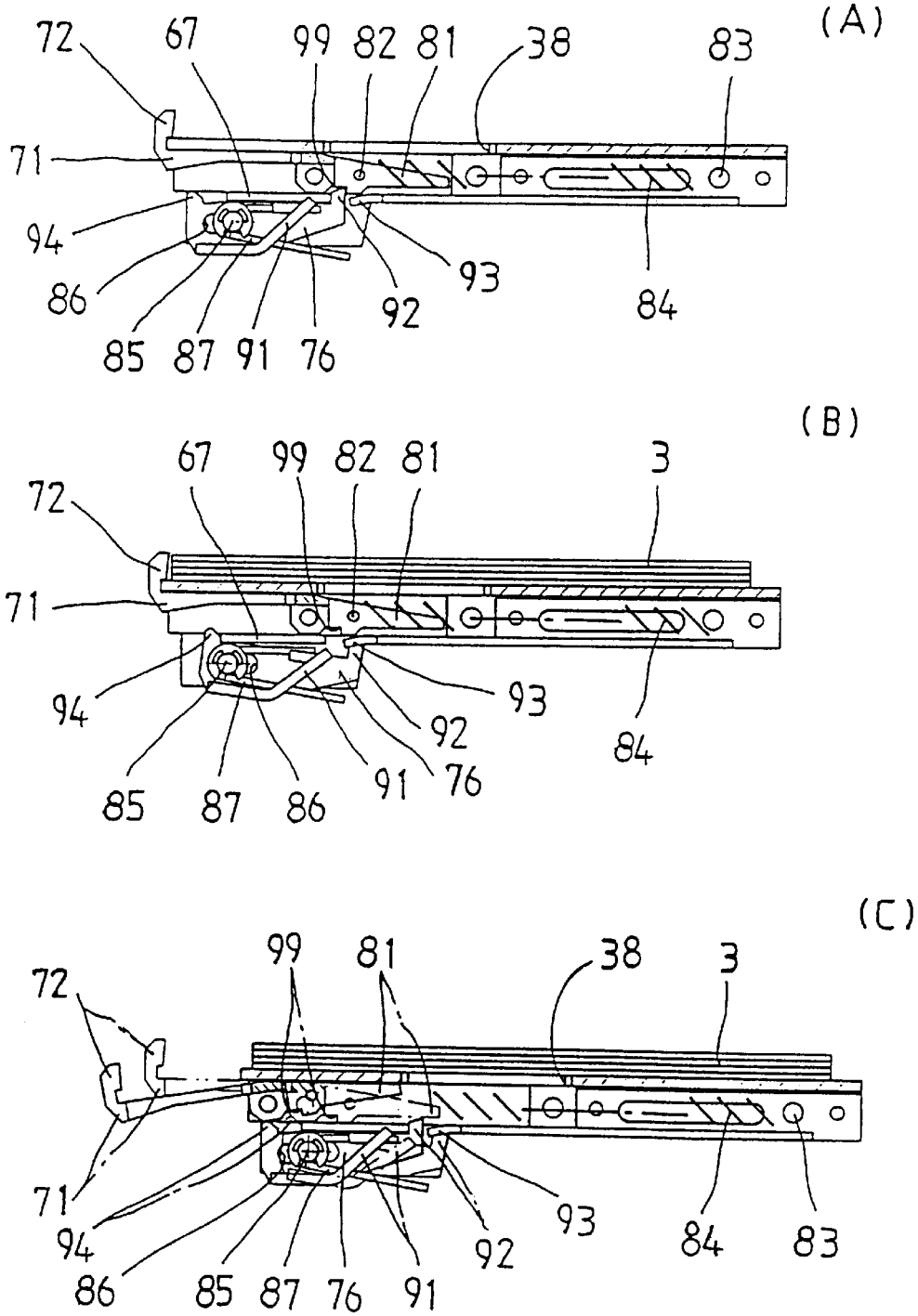
FIGS. 8A–8C illustrate different stages in operation of the card retainer mechanism.

In more detail, when the card retainer 71 is drawn out towards the left side as can be seen in FIG. 8, against the action of the spring 84, the projection 94 on the latch body 76 is moved towards the left by the underside of the card retainer 71. Thus, the latch body 76 with the oval hole 86 is moved towards the left in FIG. 8 against the resilience of the spring 87. As a result, the projection 92 disengages from the extension 93 and, due to the force of the spring 87, passes beyond the plate 77. Further, a stop flange 67 which is formed in front of the plate 77 regulates movement of the latch body 76 depending on the spring 87.

Figure 2:
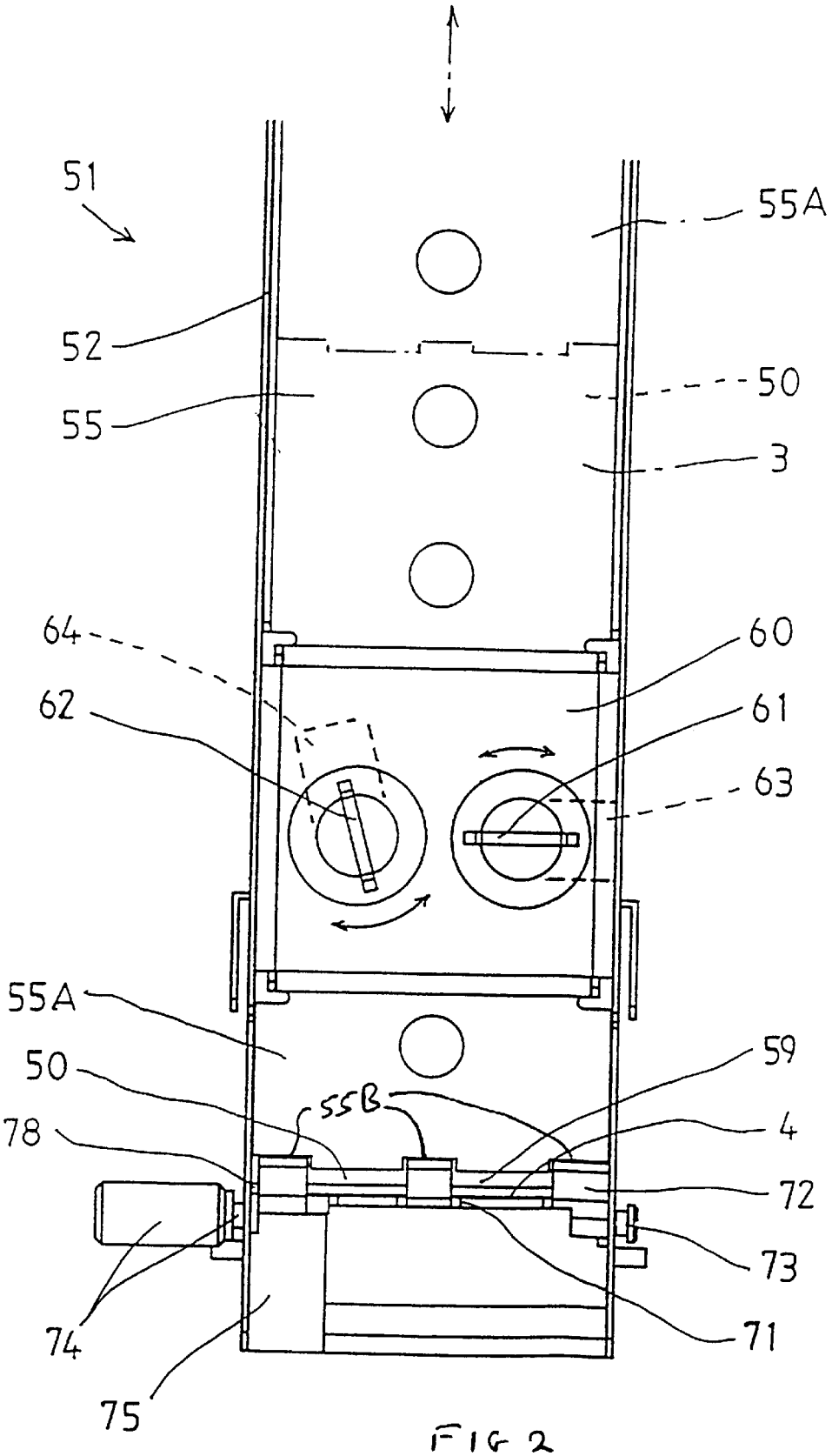
FIG. 2 is an enlarged front view of part of the cassette shown in FIG. 1.

When the cassette 61 is removed from the card dispensing apparatus 30, the operator first inserts the second key 62 into its lock and rotates the projection 64 to its unlocked position (FIG. 2). As a result, the spring 98 acts and the lock plate 97 rises so that the lever arm 74 becomes free and the spring 84 then acts to move the lever arm to the position shown in FIG. 5. Accordingly, the operator can then remove the cassette 51 from the card dispensing apparatus 30 in an upward direction.

At this time, the security mechanism within the housing 75 returns to its original condition. That is, it takes up the condition shown in solid lines in FIG. 3. As can be seen in FIG. 8A, the card retainer 71 is moved to the right under the influence of the spring 84. Then, under the action of the spring 87, the projection 92 cuts into the notch 99 of the rear projection 81 of the card retainer so that it is impossible to draw the retainer 71 out again. In other words, the condition shown in FIGS. 1 and 2 has been reached.

In order to take cards out from the cassette 51, the first key 61 is inserted into its lock and the projection 63 rotated to its unlocked position. Accordingly, because the front panel 55 can be moved vertically, the cards 3 can be taken out from the inside of the cassette 51. It should be noted that while the cassette 51 is locked by the first key 61 which is removed by a manager or the like, the card retainer 71 is sometimes drawn out on malfunction of the dispenser 74. In this case, as shown in FIG. 5C, the projection 94 is moved and the projection 92 slides beyond the extension 93, and then a spring 84 acts to return the card retainer 71 to its original position.

Thus, as shown in FIG. 8A, the spring 87 acts and the projection 92 cuts into the notch 99 and the card retainer 71 is not drawn out. This prevents spills of cards from the cassette 51.

It should also be noted that when the card retainer 71 returns to its closed position as shown in FIG. 8B, any cards 3 protruding through the dispense outlet will be returned into the stack.

In some cases, the security mechanism housed within the housing 75 could be omitted and reliance placed simply on the use of the two locks 61,62.

The cassette 51 may be made transparent or opaque from a resin formed product or the like. In some cases, the cassette could be disposable allowing the locks 61,62 to be omitted.

Although FIG. 7 illustrates the use of a weight 39 to urge the stack of cards against the bottom plate 4 and also to assist gravity, other means for achieving this urging could be provided such as a spring. This would also allow the cassette to be laid horizontally.

Figure 9:
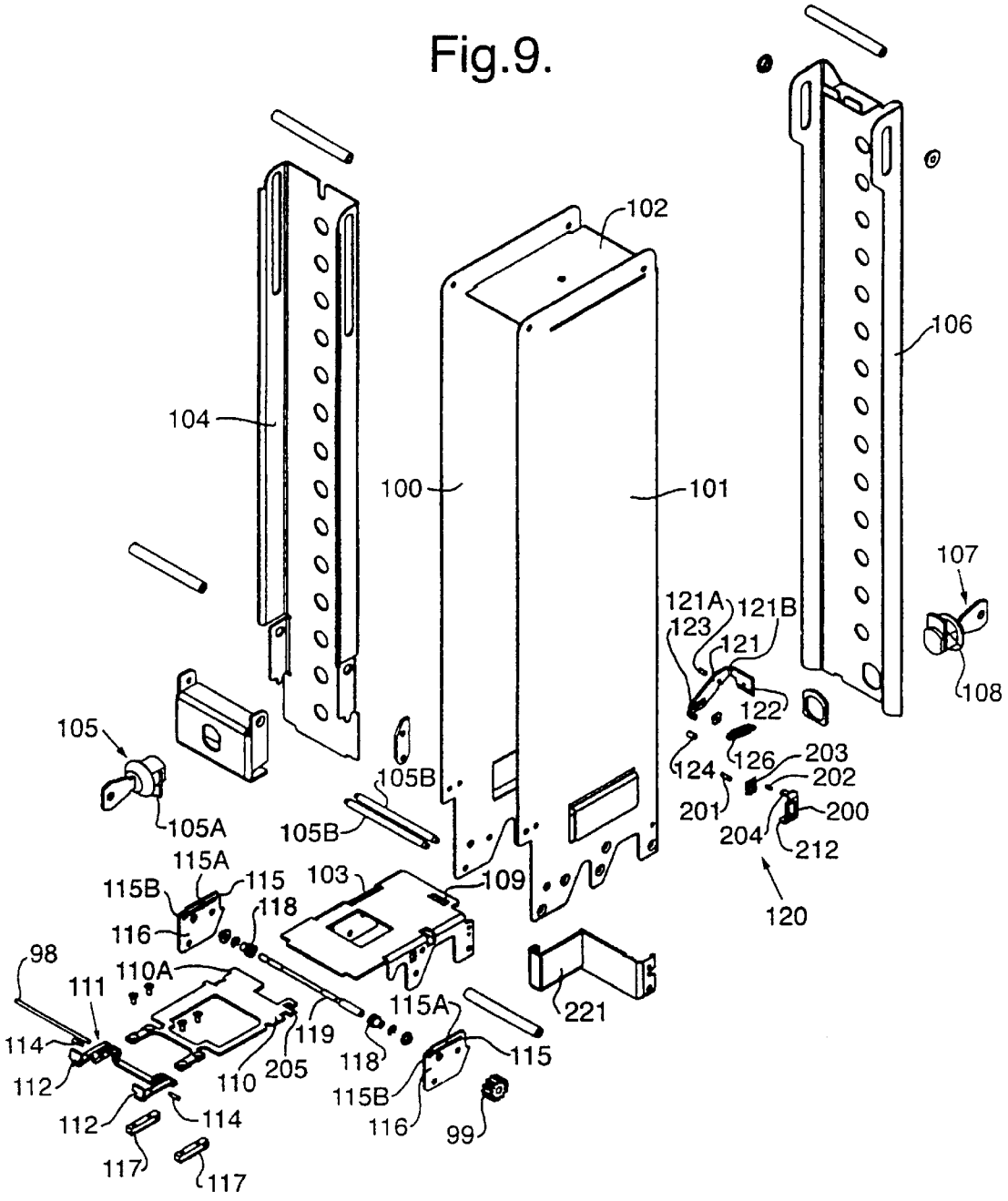
FIG. 9 is an exploded view of a second example of a cassette according to the invention.

A second embodiment of the invention will now be described with reference to FIGS. 9 to 16. This is the preferred embodiment and it based closely on the first embodiment but with certain modifications, particularly in the locking mechanism. As can be seen in FIGS. 9 and 10, the cassette comprises a pair of side plates 100, 101 secured at their upper end by a plate 102 and at their lower end by a base plate 103 on which cards to be dispensed are stacked in use. The cassette has a front plate 104 pivoted at its upper end between the plates 100, 101 and lockably secured at its lower end via a lock mechanism 105. The lock mechanism 105 has a pawl 105A which, in the locking position, engages between a pair of rods 105B secured between the side plates 100,101 (see FIG. 14).

A rear plate 106 is pivoted at its top between the side plates 100,101 and is also locked at its lower end to the base plate 103 via a locking mechanism 107 having a pawl 108 which locates in a locking aperture 109 of the plate 103 (see FIG. 9).

Slidably mounted beneath the base plate 103 is a latch plate 110 having a card retainer 111 secured to it at its front end. The card retainer 111 has a pair of upwardly extending lips 112 which, as can be seen in FIG. 10C, extend across a dispense outlet 113 located between the base of the front plate 104 and the upper surface of the base plate 103. The card retainer 111 has a pair of laterally extending, small pins 114 and a large rod 98 which engage in respective slots 115 of a pair of small subsidiary side plates 116 located on the inner surfaces of respective side walls 100,101 of the cassette. Each slot 115 has a horizontally extending portion 115A which communicates with a downwardly extending portion 115B. Thus, as the latch plate 110 and card retainer 111 are pushed forward, the pins 114 will be moved along the slots 115 until finally they move downwardly in the portions 115B so as to move the card retainer 111 downwardly, about the rod 98, out of alignment with the dispense outlet 113 (see FIG. 16). A pair of springs 230 are attached on opposite sides of the latch plate 110 and are anchored to the side plates 100, 101 respectively to urge the latch plate towards its retracted position.

A pair of small racks 117 are secured beneath the latch plate 110 and engage respective pinions 118 fixed to an axle 119 which extends between the plates 116. The end of the axle 119 protruding through the plate 116 attached to the side plate 101 supports a gear 99.

Figure 10A:
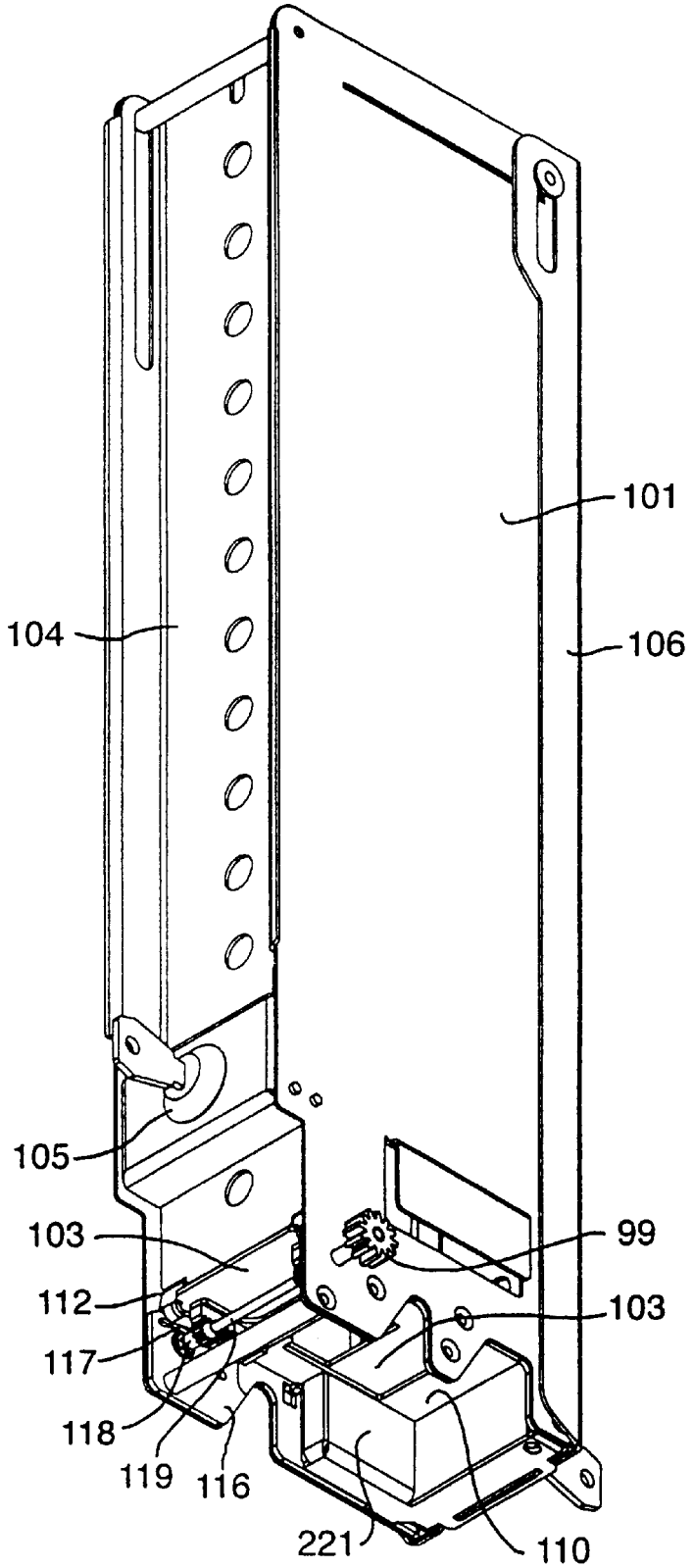
FIGS. 10A–10C are perspective views from below, the front and one side; a perspective view from above, the rear and the other side; and a perspective view from above, the front and the one side respectively of the cassette shown in FIG. 9.
Figure 14:
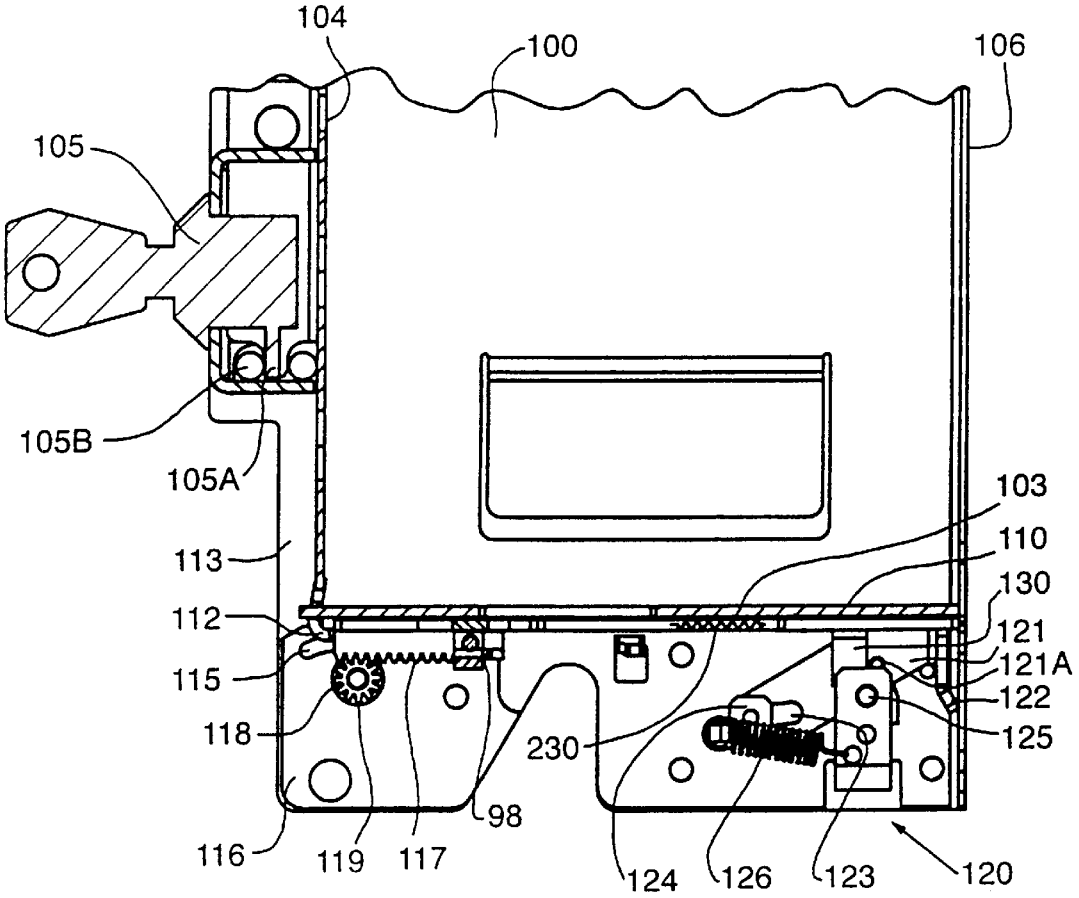
FIGS. 14, 15 and 16A are views of different stages of deployment of the card retainer and associated latch mechanism.

In order to prevent the card retainer 111 from being moved to its open position when a cassette is not in use, a lock-out latch mechanism 120 is provided located behind a cover 221 (FIG. 10A) . As can be seen in FIG. 14, for example, the lock-out mechanism 120 comprises a U-shaped latch member 121 having an actuator portion 122, the latch member 121 having an elongate slot 123 via which it is mounted by a bolt 124 for sliding movement to the side plate 100. The latch member 121 is urged towards its locking position shown in FIG. 14 by an extension spring 126. Hence, as can be seen in FIG. 14, the latch member 121 is urged upwardly and in its locking to position, as shown, will engage behind a flange 110A in the latch plate 110.

Figure 10B:
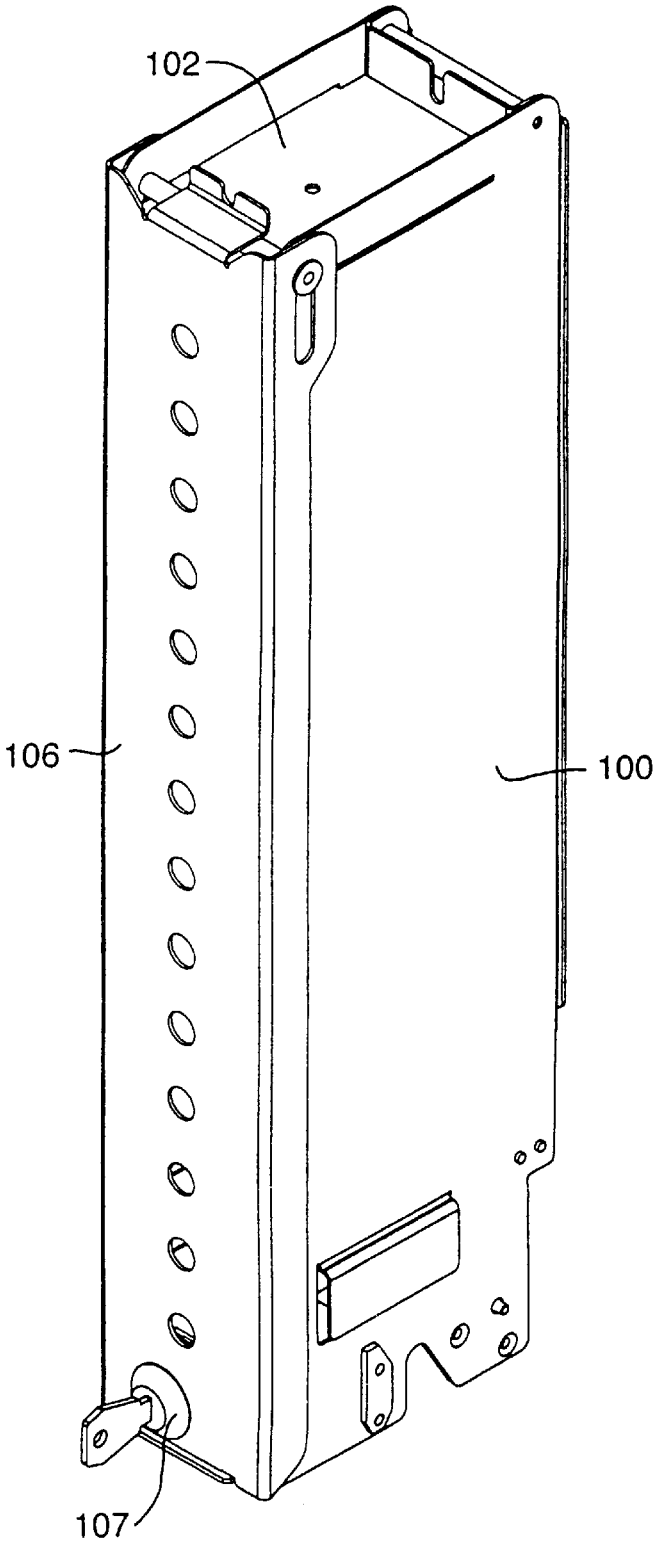
Figure 10C:
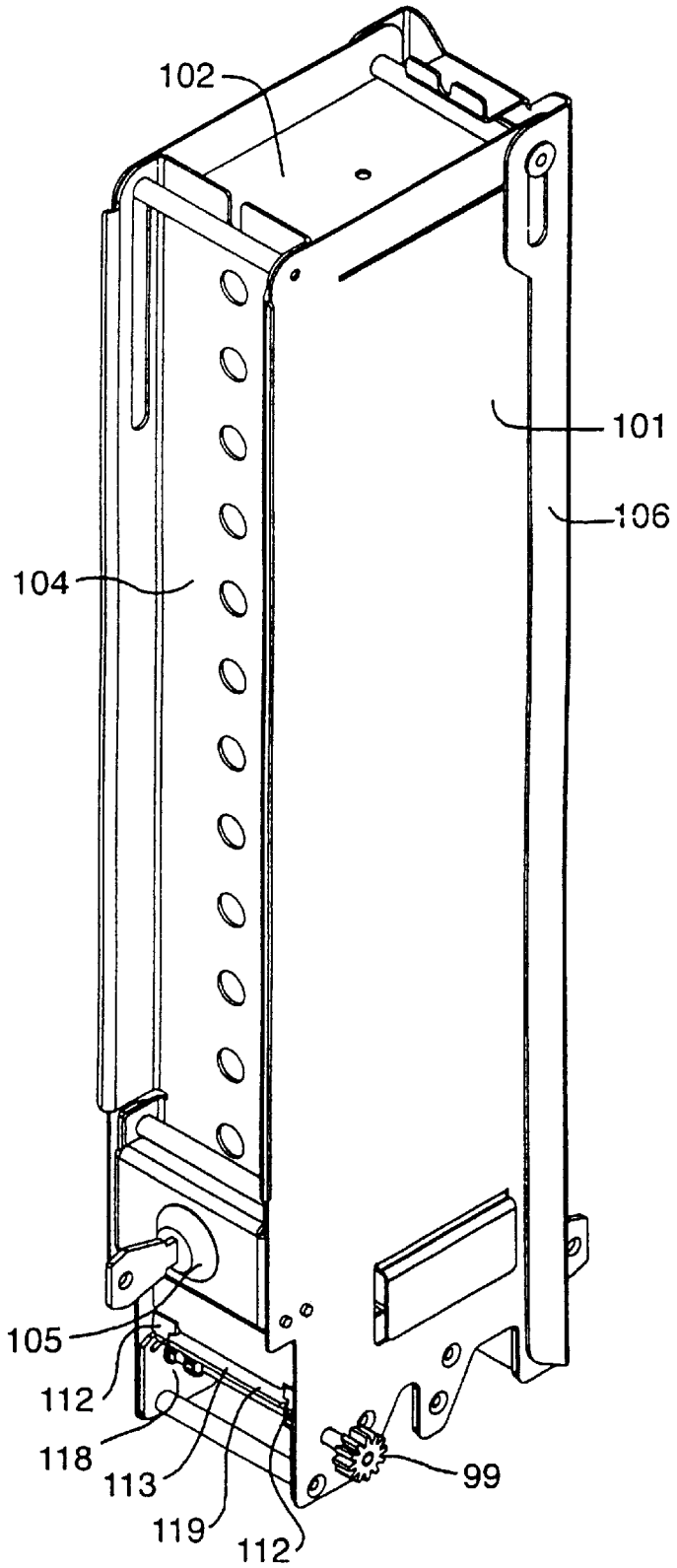
Figure 13:
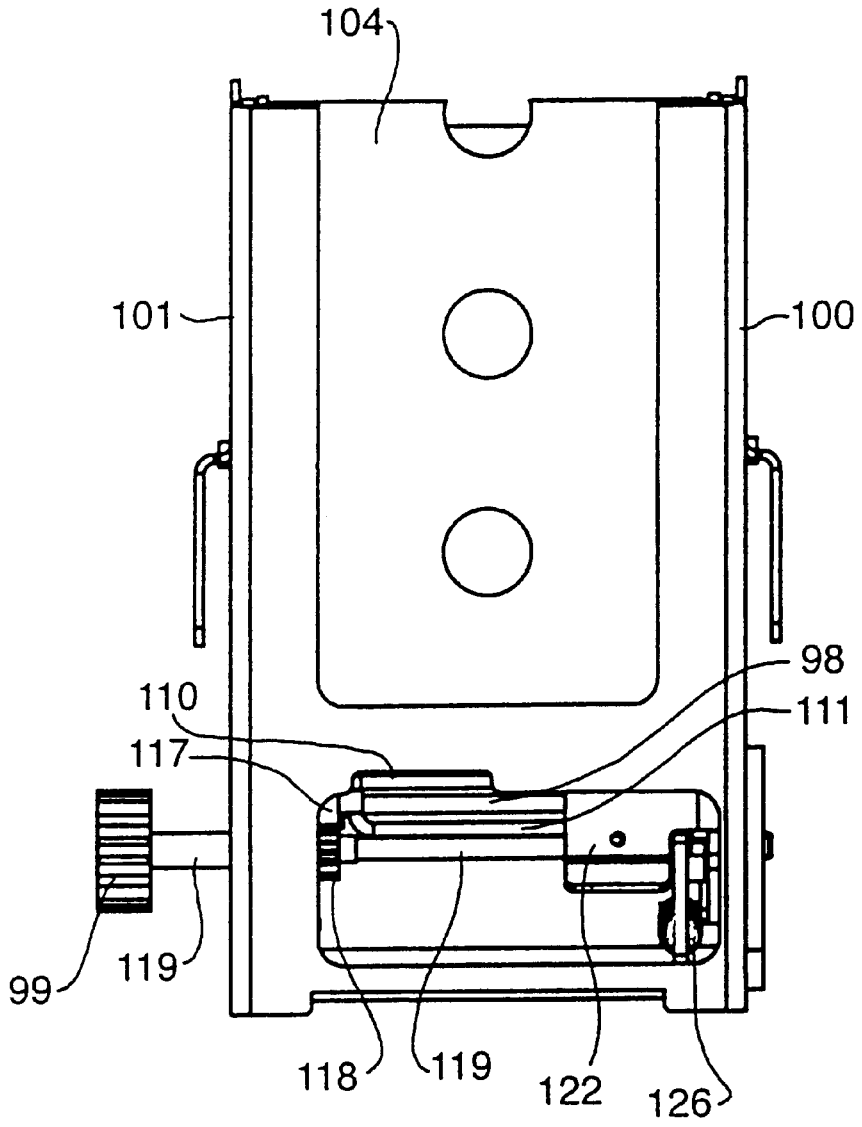
FIG. 13 is a partial rear view of the cassette shown in FIGS. 9 and 10 with the rear plate removed.

As can be seen in FIG. 10B, access to the actuator 122 is normally prevented by the locked rear plate 106. When the plate 106 is unlocked and moved, the actuator 122 becomes visible as can be seen in FIG. 13.

Figure 15:
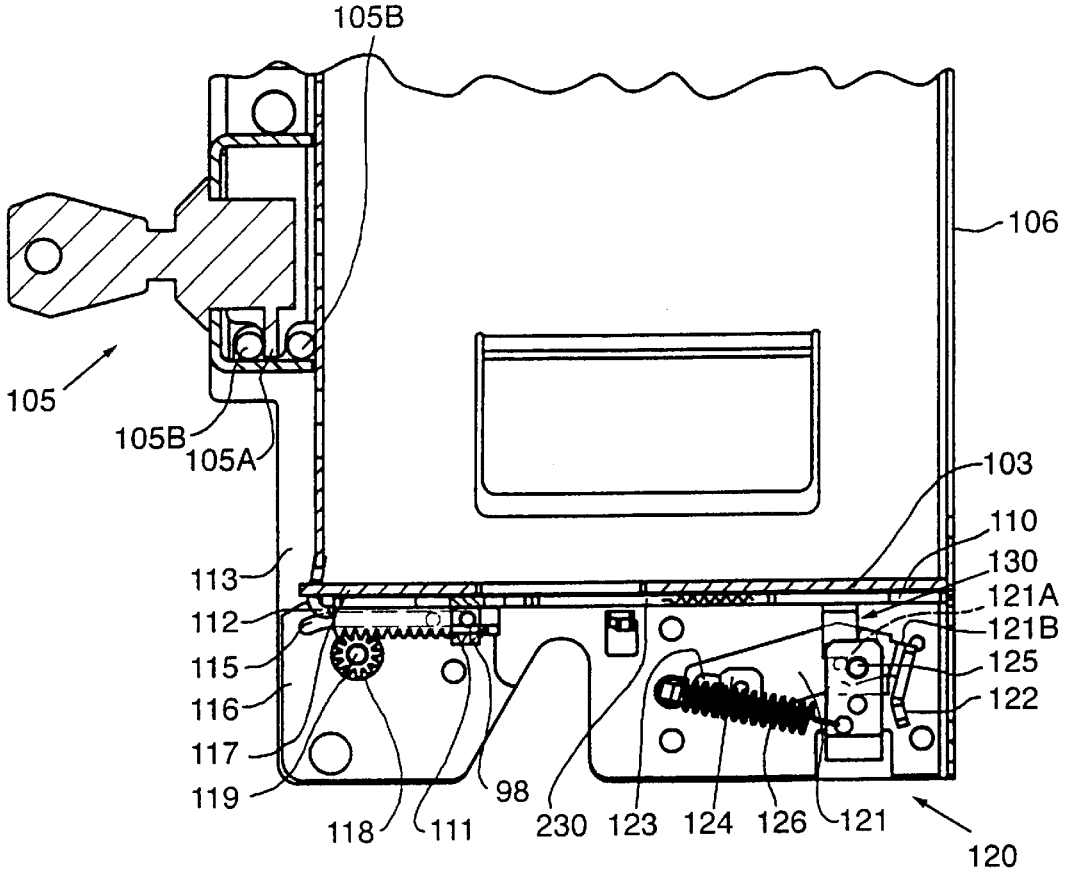
Figure 16A:
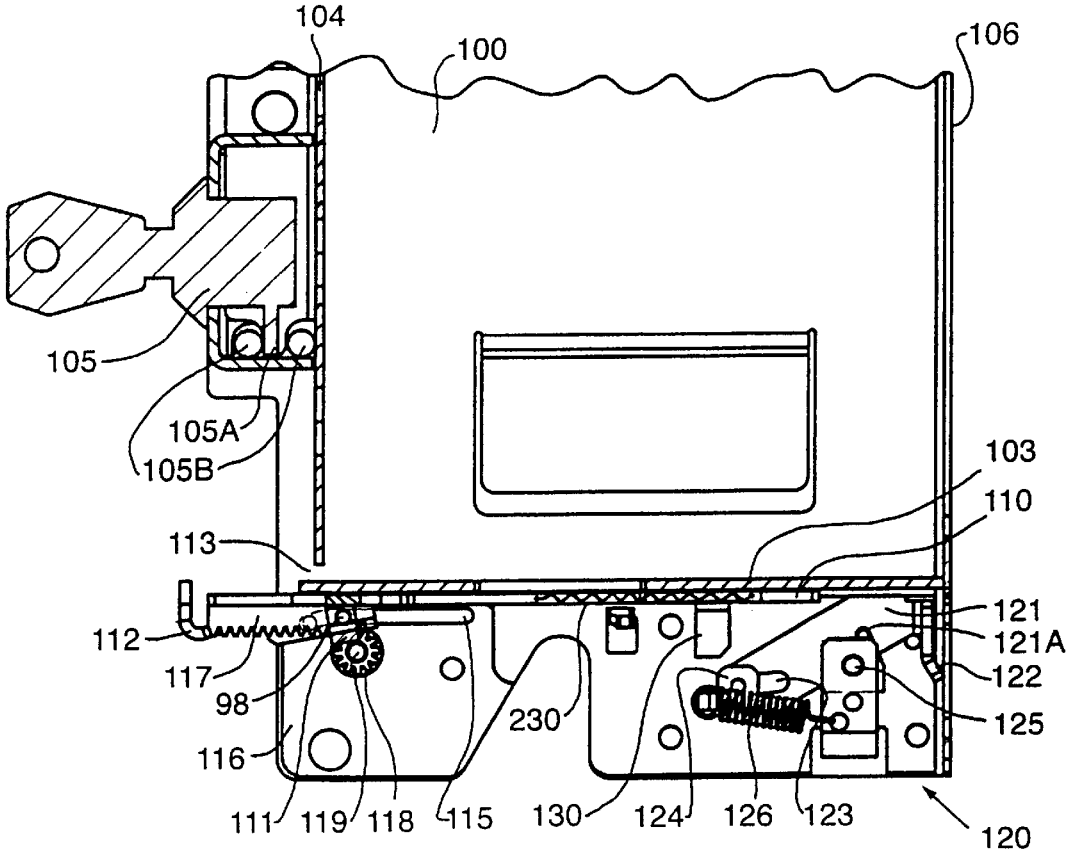
Figure 16B:
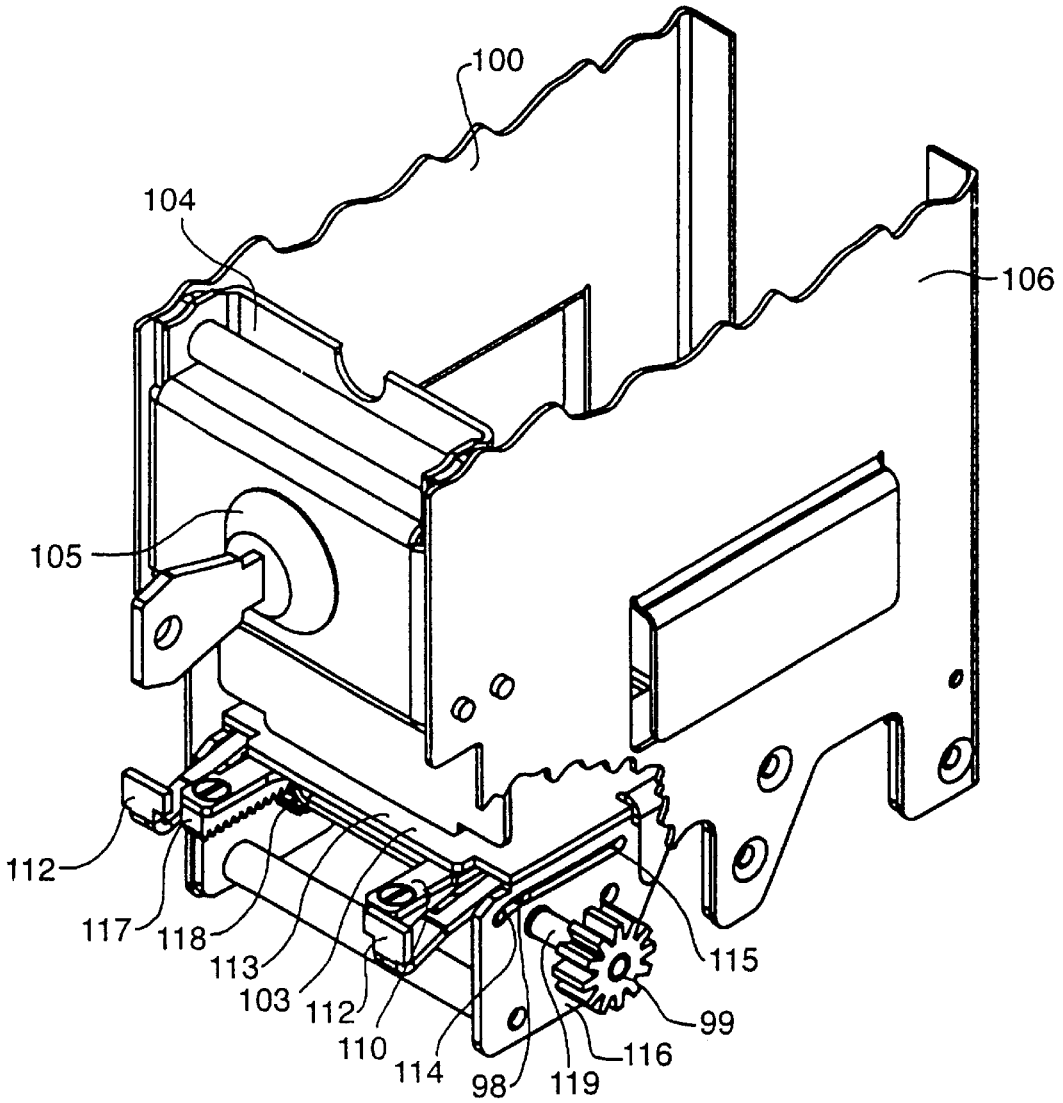
FIG. 16B is a perspective view from above, the front and one side of part of the cassette when in the configuration shown in FIG. 16A; and, FIG. 17 is an enlarged perspective view from below of part of the cassette in FIG. 9 with some parts omitted for clarity.

In order to load the cassette, one or both of the front and back plates 104,106 is unlocked and moved away from the rest of the cassette so that cards can be inserted so as to rest on the base 103. The front and rear plates are then locked and the cassette can then be freely transported while the contents remain secure. When the cassette is to be mounted on a dispenser, the rear plate 106 is unlocked and the operator pushes the actuator 122 downwards and towards the front as can be seen in FIG. 15. This causes the latch member 121 to be slid towards the front due to the presence of the slot 123, thus withdrawing a projection 121B of the latch member from engagement with the flange 110A, while a pin 121A on the latch member 121 engages the underside of the depending latch plate tab 130 and lodges against a laterally extending pin 125. In the position shown in FIG. 15, the latch member 121 is retained under spring tension against the latch plate tab 130 and the pin 125 and the mechanism is primed. Subsequently, when the card retainer 111 is moved forward as shown in FIG. 16, against the return force of the springs 230, the latch member 121 will return to its original locked position as shown in FIG. 14 so that when the card retainer 111 is returned to its closed position, the projection 121B of the latch member 121 will automatically reengage and lock the card retainer 111 in position.

Figure 11:
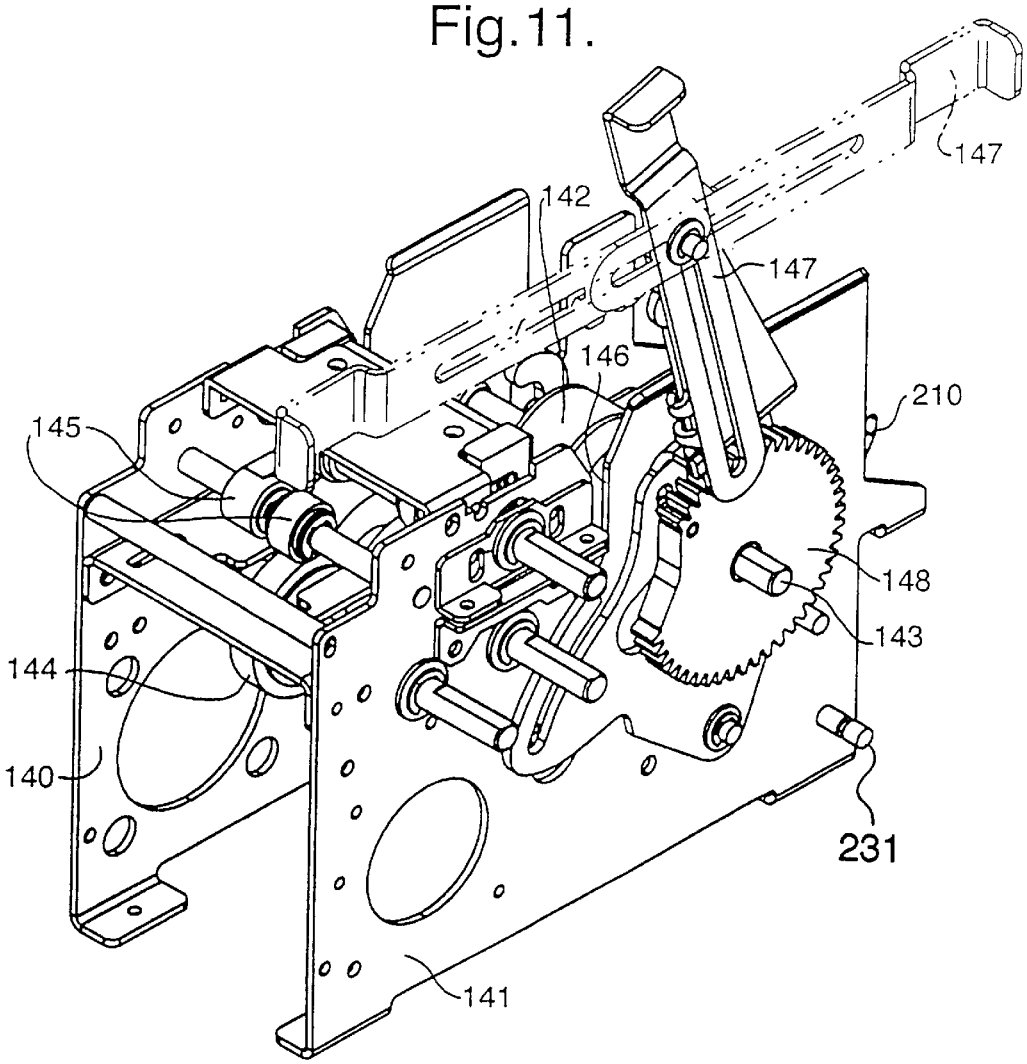
FIG. 11 is a perspective view of a dispenser for use with the cassette shown in FIGS. 9 and 10.

FIG. 11 illustrates a dispenser to which the cassette shown in FIGS. 9 and 10 can be located. As in the previous example, the dispenser has a pair of side plates 140, 141 secured in a spaced apart configuration by a number of spacers. A feed roller 142 fixed to an axle 143 is provided in alignment with a further feed roller 144 and separation rollers 145 which are rotated in reverse relative to the roller 144 as in the previous example.

Figure 12:
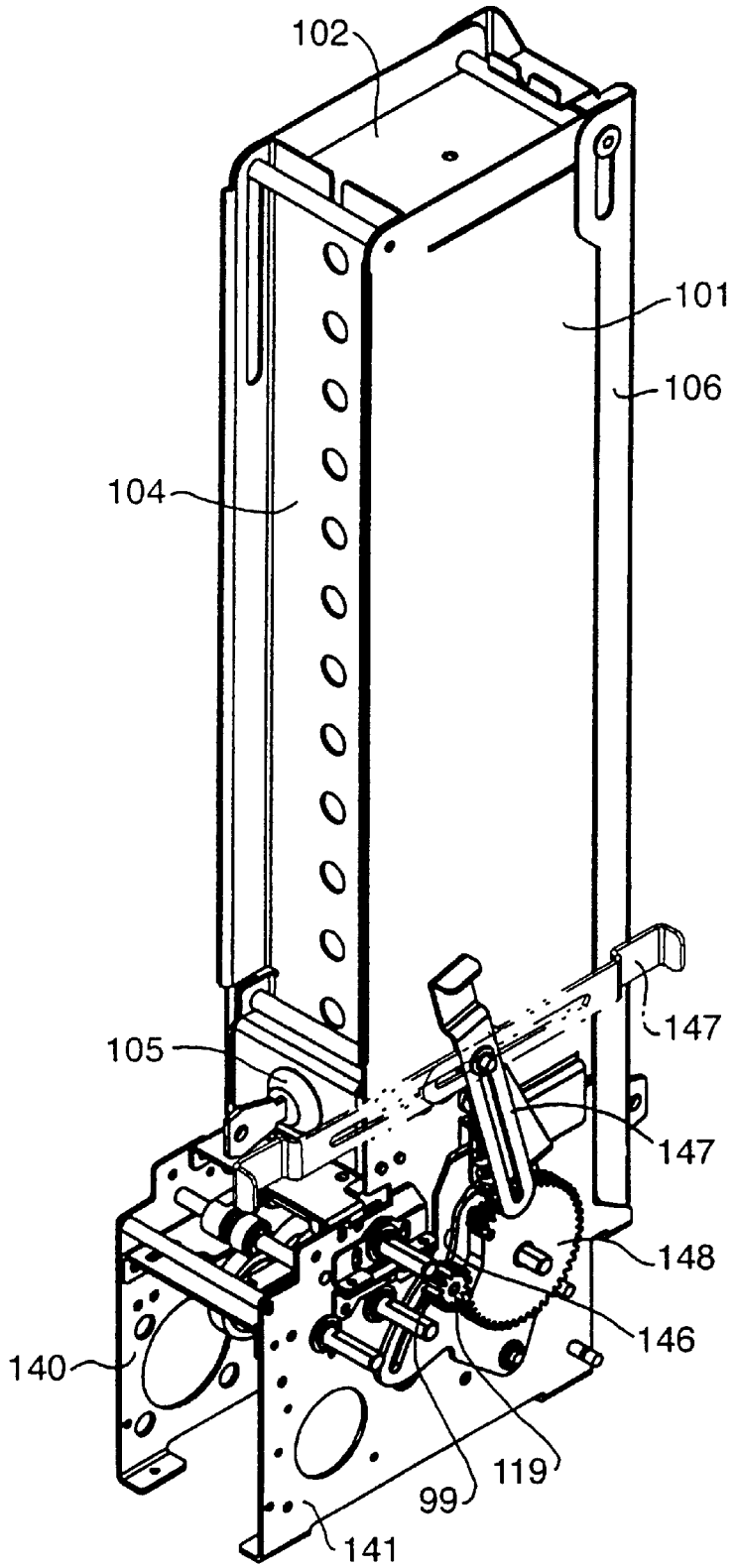
FIG. 12 is a view of the cassette shown in FIGS. 9 and 10 mounted to the dispenser shown in FIG. 11.

As can be seen in FIG. 12, when the cassette is mounted onto the dispenser, the axle 119 where it protrudes beyond the side plate 101 locates in a slot 146 in the side plate 141 of the dispenser. Prior to mounting the cassette on the dispenser, the lever arm 147, attached to a shaft 143 carrying a gear 148, is moved in an anti-clockwise direction, as seen in FIG. 11, against the bias of a spring 230 connected between the lever arm 147 and a pin 231. After the cassette is in position, the lever arm 147 is moved clockwise so that the teeth on the gear 148 engage and rotate the gear 99 in an anti-clockwise direction (FIG. 12) thus moving the card retainer 111 to its open or dispense position shown in FIG. 16. At the same time, this movement of the lever arm 147 will effectively lock the cassette onto the dispenser by engagement between the gears 99, 148. In order to remove the cassette, it is necessary to move the lever arm 147 back to the position shown in FIG. 12 which will automatically cause the card retainer 111 to be retracted thus drawing any protruding cards back into the cassette through the dispense outlet 113.

The lever arm 147 is rotatable on its support to enable it to take up a horizontal position as shown in chain lines in FIG. 12.

Prior to operating the lever arm 147, it is necessary to prime the latch mechanism and this can be done either before the cassette is mounted on the dispenser or afterwards. Following the priming action, however, the rear plate 106 is locked in its closed position.

Figure 17:
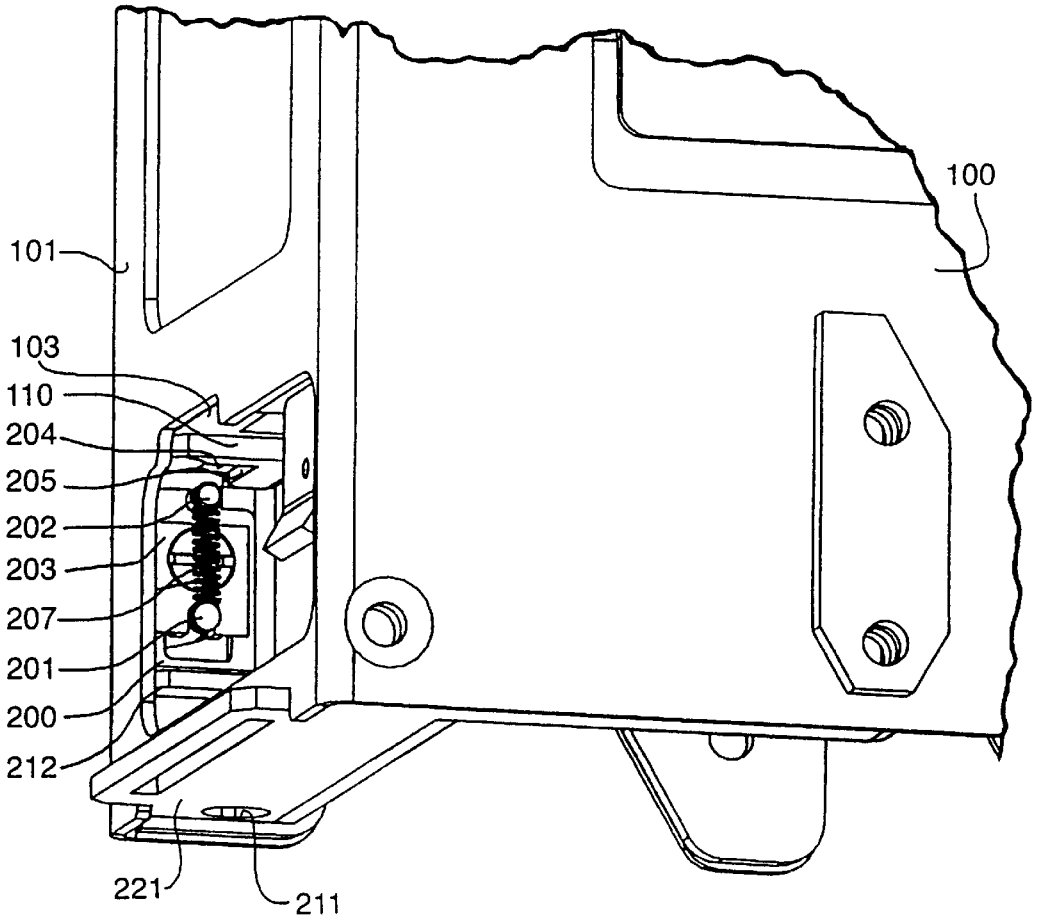

To avoid inadvertent movement of the card retainer 111 if it is already in its primed position before being located on the dispenser, a ring shaped latch member 200 is provided slidably mounted to the side plate 101. The latch member 200 includes a pin 202. A tension spring 207 extends from the pin 202 to a further pin 201 connected to the side plate 101 so that the latch member 200 is urged in a downward direction. This movement is limited by a stop plate 203 attached to the latch member 200. A laterally inwardly extending pin 204 is provided at the upper end of the latch member 200 and when the latch plate 110 is in its retracted position (FIG. 17), the pin 204 engages in a recess 205 defined at the rear of the latch plate 110 (FIG. 9). In this condition, as seen in FIG. 17, even though the latch member 121 has been released, the latch plate 110 cannot be moved.

The latch member 200 is released when the cassette is mounted on the dispenser. The dispenser includes a dagger pin 210 (FIG. 11) at its rear which passes through an aperture 211 in the base of the cassette and engages a laterally extending flange 212 of the latch member 200. This pushes the latch member 200 upwards against the spring action thus disengaging the pin 204 from the recess 205 and allowing the plate 110 to move forwardly. When the cassette is removed from the dispenser, the dagger pin will be extracted from the aperture 211 and the latch member 200 will return to the position shown in FIG. 17.

It is possible that an attempt might be made to gain access to the cassette after the actuator 122 has been unlocked but before the cassette is mounted on the dispenser. Such an attempt will initially be frustrated by the presence of the latch member 200. If the latch member 200 is released by inserting an elongate member into the hole 211, the card retainer 111 could be pulled forward but as soon as it was released, the springs 230 would pull it back to its closed or retracted position and the latch member 121 would automatically reengage and it would be impossible to place the cassette on the dispenser without repeating the unlocking operation of the latch member 121. This provides tamper evidence.

As in the previous example, the dispenser will be connected to appropriate control equipment for responding to an operator request to dispense one or more cards, thus causing appropriate rotation of the feed rollers.

The features described in specification, drawings, abstract, and claims, can be used individually and in arbitrary combinations for practicing the present invention.

While specific embodiments of the invention have been shown and described in detail to illustrate the application of the principles of the invention, it will be understood that the invention may be embodied otherwise without departing from such principles.

What is claimed is:

1. A card dispensing cassette comprising:

a housing in which cards are stacked in use;

a dispense outlet in the housing through which cards are laterally dispensed from the cassette;

a card retainer, cooperating with the dispense outlet, mounted to the cassette for substantial lateral movement between a closed position in which cards cannot be dispensed and an open position in which cards can be dispensed, the card retainer having a retaining lip which engages any cards protruding through the dispense outlet when the card retainer moves to its closed position so as to return those cards into the cassette, and, a handle coupled to the card retainer and extending through an aperture in a wall of the housing to enable the card retainer to be moved.

2. A cassette according to claim 1, wherein:

the card retainer includes a window through which cards in the stack can be engaged by a feed member.

3. A cassette according to claim 1, wherein:

the housing has a cover which is locked to the remainder of the housing.

4. A cassette according to claim 1, further comprising:

a lock member which can be moved to a locking position in which it engages a dispenser to lock the cassette to the dispenser.

5. A cassette according to claim 1, further comprising:

guide means for causing the card retainer to tip during its movement towards the open position so as to reduce interference between the lip and the path of cards being dispensed.

6. A cassette according to claim 5, wherein:

the guide means comprises a cooperating pin and slot.

7. A cassette according to claim 6, wherein:

the pin extends laterally from the card retainer and the slot is provided in the wall of the housing.

8. A card dispensing cassette according to claim 1, further comprising:

a gear assembly secured to the card retainer for coupling the card retainer to a gear of a drive shaft which is connected in use to an actuator of a dispenser for feeding cards from the cassette through the dispense output, to which dispenser the cassette can be mounted.

9. A cassette according to claim 8, wherein;

the gear assembly comprises a rack and pinion.

10. A card dispensing cassette according to claim 1, further comprising:

a first latch member movable between a locked position in which the first latch member engages and locks the card retainer in its closed position and a released position in which the card retainer can be moved to its open position.

11. A cassette according to claim 10, wherein:

the first latch member is primed in its released position to return to the locked position once the card retainer has been moved to its open position whereby the card retainer is automatically locked by the first latch member when the card retainer returns to its closed position.

12. A cassette according to claim 10, wherein:

the first latch member can only be unlocked from within the housing.

13. A cassette according to claim 10, further comprising:

a second latch member which locks the card retainer in its closed position and is releasable by a user to allow the card retainer to be moved to its open position.

14. Card dispensing apparatus comprising:

a card dispensing cassette including a housing in which cards are stacked in use, a dispense outlet in the housing through which cards are laterally dispensed from the cassette, and a card retainer, cooperating with the dispense outlet, mounted to the cassette for substantial lateral movement between a closed position in which cards cannot be dispensed and an open position in which cards can be dispensed, the card retainer having a retaining lip which engages any cards protruding through the dispense outlet when the card retainer moves to its closed position so as to return those cards into the cassette;

a dispenser to which the cassette can be mounted, the dispenser being adapted to feed cards from the cassette through the dispense outlet to an output position;

the cassette including a gear assembly secured to the card retainer and, the dispenser includes a card retainer actuator connected to a drive shaft carrying a gear which engages the gear assembly on the cassette coupling the card retainer to the drive shaft when the cassette is located in position on the dispenser.

15. Apparatus according to claim 14, wherein:

operation of the actuator both locks the cassette to the dispenser and moves the card retainer to its open position.

16. Apparatus according to claim 14, wherein:

the cassette includes a latch member which locks the card retainer in its closed position and is releasable by a user to allow the card retainer to be moved to its open position;

the dispenser further includes a release member which releases the latch member when the cassette is mounted on the dispenser.

17. Apparatus according to claim 16, wherein:

the release member comprises a pin.

18. Card dispensing apparatus comprising:

a card dispensing cassette including a housing in which cards are stacked in use, a dispense outlet in the housing through which cards are laterally dispensed from the cassette, and a card retainer, cooperating with the dispense outlet, mounted to the cassette for substantial lateral movement between a closed position in which cards cannot be dispensed and an open position in which cards can be dispensed, the card retainer having a retaining lip which engages any cards protruding through the dispense outlet when the card retainer moves to its closed position so as to return those cards into the cassette;

a dispenser to which the cassette can be mounted, the dispenser being adapted to feed cards from the cassette through the dispense outlet to an output position;

the cassette including a latch member which locks the card retainer in its closed position and is releasable by a user to allow the card retainer to be moved to its open position;

the dispenser including a release member which releases the latch member when the cassette is mounted on the dispenser.

19. A cassette for dispensing cards comprising:

a housing including side walls upstanding from a base wall for supporting cards to be dispensed in a stack;

a card dispensing outlet formed between a side wall and the base wall;

a card retainer mounted on the housing for movement between inner and outer positions closing and opening the outlet, respectively, a first latching member provided on the card retainer for latching the card retainer in an inner position closing the outlet;

a first spring biasing the first latching member into the housing;

means for moving the first latching member out of the housing against the biasing of the first spring;

a second latching member provided on a housing wall;

a third latching member mounted on a housing wall for swiveling movement between positions of latching engagement with the first latching member for latching the card retaining member in a position closing the outlet and with the second latching member permitting outward movement of the card retainer to a position opening the outlet;

and means, operable by movement of the card retainer, for freeing the third latching member from engagement with the second latching member to permit engagement of the third latching member with the first latching member.

* * * * *